US011398191B2

(12) United States Patent
Kim et al.

(10) Patent No.: US 11,398,191 B2
(45) Date of Patent: Jul. 26, 2022

(54) TIMING CONTROLLER, ORGANIC LIGHT-EMITTING DISPLAY APPARATUS, AND DRIVING METHOD THEREOF

(71) Applicant: LG DISPLAY CO., LTD., Seoul (KR)

(72) Inventors: Youngchan Kim, Gyeonggi-do (KR); Jaehwan Yun, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/562,057

(22) Filed: Sep. 5, 2019

(65) Prior Publication Data

US 2020/0074939 A1 Mar. 5, 2020

(30) Foreign Application Priority Data

Sep. 5, 2018 (KR) ..... 10-2018-0105745

(51) Int. Cl.
*G09G 3/3291* (2016.01)
*G09G 3/3258* (2016.01)
*G09G 3/3233* (2016.01)

(52) U.S. Cl.
CPC ..... *G09G 3/3291* (2013.01); *G09G 3/3233* (2013.01); *G09G 3/3258* (2013.01); *G09G 2300/0842* (2013.01); *G09G 2310/027* (2013.01); *G09G 2310/08* (2013.01); *G09G 2320/0257* (2013.01); *G09G 2320/045* (2013.01); *G09G 2320/103* (2013.01); *G09G 2360/18* (2013.01)

(58) Field of Classification Search
CPC .. G09G 3/3291; G09G 3/3258; G09G 3/3233; G09G 2310/08; G09G 2320/045; G09G 2310/027; G09G 2300/0842; G09G 2320/103; G09G 2320/0257; G09G 2360/18; G09G 2300/0819
See application file for complete search history.

(56) References Cited

U.S. PATENT DOCUMENTS

2011/0298774 A1* 12/2011 Yamada ..... G09G 3/3614 345/211
2014/0176525 A1 6/2014 Woo et al.
2015/0154908 A1* 6/2015 Nam ..... G09G 3/3233 345/76

(Continued)

FOREIGN PATENT DOCUMENTS

CN 102334153 A 1/2012
CN 103886831 A 6/2014

(Continued)

*Primary Examiner* — Roberto W Flores
(74) *Attorney, Agent, or Firm* — Seep IP Law Group LLP

(57) ABSTRACT

An organic light-emitting display device includes: a display panel in which a plurality of data lines and a plurality of gate lines are arranged to overlap each other and that includes a plurality of subpixels which are arranged in areas in which the plurality of data lines and the plurality of gate lines overlap each other; a data driver that supplies a data signal to the plurality of data lines; a gate driver that supplies a gate signal to the plurality of gate lines; and a timing controller that controls the data driver and the gate driver such that the data driver outputs a sensing voltage in a first section, outputs a compensation voltage in a second section, and outputs a data voltage in a third section.

11 Claims, 12 Drawing Sheets

(56) References Cited

U.S. PATENT DOCUMENTS

| | | | | |
|---|---|---|---|---|
| 2016/0189617 | A1* | 6/2016 | Park | G09G 3/3258 345/690 |
| 2016/0351096 | A1* | 12/2016 | Tani | G09G 3/3233 |
| 2017/0038898 | A1* | 2/2017 | Kim | G09G 3/3233 |
| 2017/0092195 | A1 | 3/2017 | Jung | |
| 2017/0124947 | A1 | 5/2017 | Kim et al. | |
| 2017/0193923 | A1 | 7/2017 | Park et al. | |
| 2018/0061293 | A1 | 3/2018 | Park | |
| 2018/0204514 | A1 | 7/2018 | Xu et al. | |
| 2018/0308414 | A1* | 10/2018 | Kang | G09G 3/3677 |

FOREIGN PATENT DOCUMENTS

| | | | |
|---|---|---|---|
| CN | 104700772 | A | 6/2015 |
| CN | 105513541 | A | 4/2016 |
| CN | 105741733 | A | 7/2016 |
| CN | 106560882 | A | 4/2017 |
| CN | 106847171 | A | 6/2017 |
| CN | 106991965 | A | 7/2017 |
| CN | 107068065 | A | 8/2017 |
| CN | 107799063 | A | 3/2018 |

* cited by examiner

TIMING CONTROLLER, ORGANIC LIGHT-EMITTING DISPLAY APPARATUS, AND DRIVING METHOD THEREOF

CROSS REFERENCE TO RELATED APPLICATION

This application claims priority from Korean Patent Application No. 10-2018-0105745, filed Sep. 5, 2018, which is hereby incorporated by reference for all purposes as if fully set forth herein.

BACKGROUND

Technical Field

Embodiments of the present disclosure relate to a timing controller, an organic light-emitting display device, and a driving method thereof.

Description of the Related Art

With advancement in information-oriented societies, requirements for display devices displaying an image have increased in various types, and various types of flat-panel display devices such as a liquid crystal display device, a plasma display device, and an organic light-emitting display device have emerged.

Recently, organic light-emitting display devices which can be easily decreased in thickness and which are excellent in viewing angle and contrast range, and the like have widely utilized. An organic light-emitting display device emits light to display an image by supplying a drive current to organic light emitting diodes which are spontaneous light emitting elements. When an organic light emitting diode emits light for a long time, deterioration occurs. Deterioration can be more likely to occur, particularly, when a still image with high luminance is displayed. An organic light emitting diode can cause a problem in that an afterimage appears to shorten a lifespan thereof due to deterioration.

A difference in threshold voltage can occur between driving transistors that supply a drive current to organic light emitting diodes due to a process deviation and thus a difference in drive current can occur between subpixels. The drive current can deviate depending on electron mobility. When a deviation in drive current occurs, there is a problem in that luminance becomes uneven and image quality degrades.

BRIEF SUMMARY

One or more embodiments of the present disclosure provide a timing controller, an organic light-emitting display device, and a driving method thereof that can prevent a degradation in image quality. The organic light-emitting display device according to one or more embodiments of the present disclosure senses characteristics based on threshold voltage and electron mobility to prevent uneven display on the device.

According to an aspect of embodiments of the disclosure, there is provided an organic light-emitting display device including: a display panel in which a plurality of data lines and a plurality of gate lines are arranged to overlap each other and that includes a plurality of subpixels which are arranged in areas in which the plurality of data lines and the plurality of gate lines overlap each other; a data driver that supplies a data signal to the plurality of data lines; a gate driver that supplies a gate signal to the plurality of gate lines; and a timing controller that controls the data driver and the gate driver such that the data driver outputs a sensing voltage in a first section, outputs a compensation voltage in a second section, and outputs a data voltage in a third section.

According to another aspect of embodiments of the disclosure, there is provided a timing controller circuit including: a data extracting unit configured to extract image data which is stored in a frame memory; a lookup table configured to store compensation voltage information on a voltage level of a compensation voltage corresponding to the image data; and a data processing unit configured to be supplied with the compensation voltage information on the voltage level of the compensation voltage from the lookup table depending on the image data extracted by the data extracting unit and to output the compensation voltage information.

According to another aspect of embodiments of the disclosure, there is provided a method of driving an organic light-emitting display device in which a plurality of data lines and a plurality of gate lines are arranged and an image including a plurality of frames is driven, the method including: a step of outputting a sensing voltage in one frame section; a step of outputting a compensation voltage in the one frame section; and a step of outputting a data voltage in the one frame section.

According to the embodiments of the disclosure, it is possible to provide a timing controller, an organic light-emitting display device, and a driving method thereof that can prevent a degradation in image quality.

DETAILED DESCRIPTION

Figure 1:
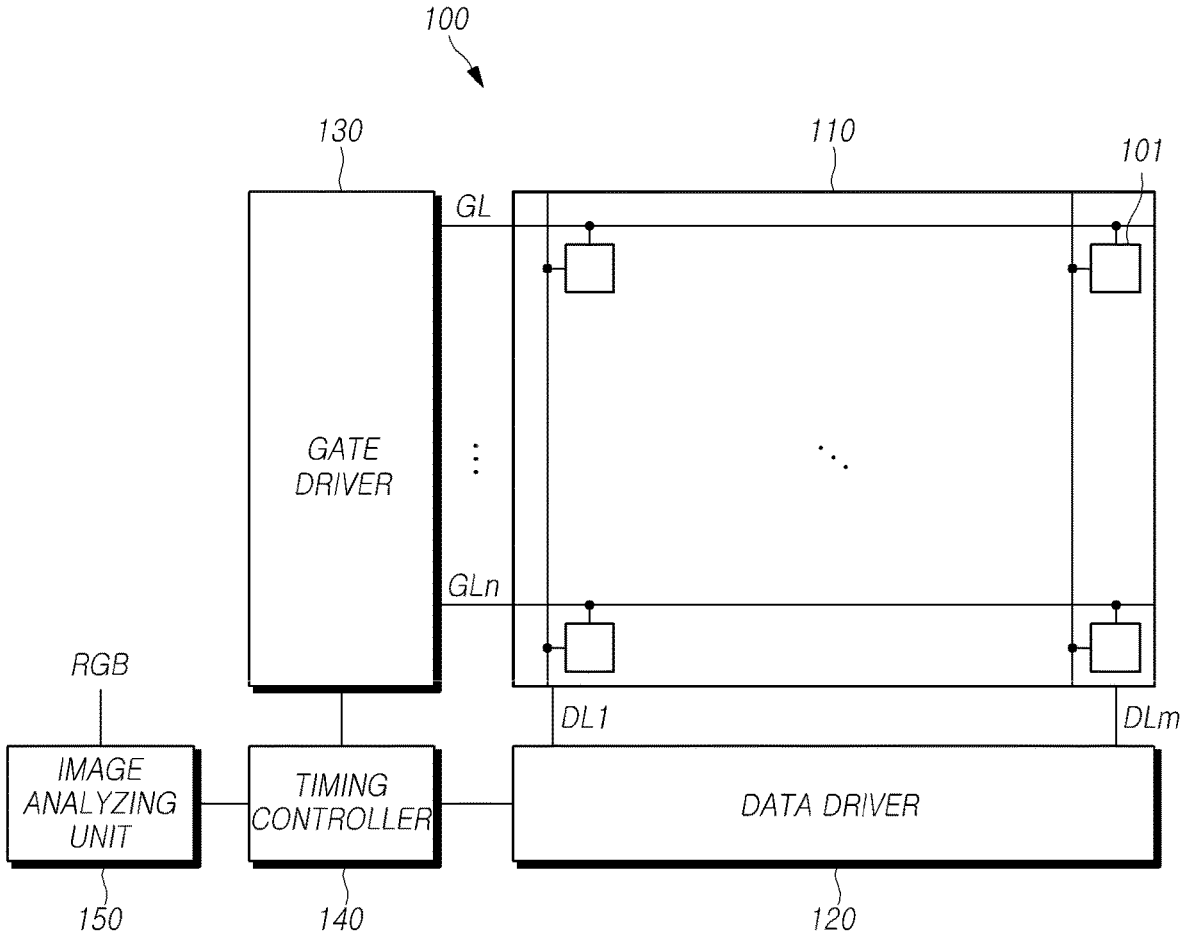
FIG. 1 is a diagram schematically illustrating an example of a configuration of an organic light-emitting display device according to embodiments of the present disclosure.

Hereinafter, some embodiments of the present disclosure will be described in details with reference to the accompanying drawings. In describing the disclosure with reference to the accompanying drawings, the same elements will be referred to by the same reference numerals or signs regardless of the drawing numbers. When it is determined that detailed description of known configurations or functions involved in the disclosure makes the gist of the disclosure obscure, the detailed description thereof will not be made.

Terms such as first, second, A, B, (a), and (b) can be used to describe elements of the disclosure. These terms are merely used to distinguish one element from another element and the essence, order, sequence, number, or the like of the elements is not limited to the terms. If it is mentioned that an element is "linked," "coupled," or "connected" to another element, it should be understood that the element can be directly coupled or connected to another element, still another element may be "interposed" therebetween, or the elements may be "linked," "coupled," or "connected" to each other with still another element interposed therebetween.

FIG. 1 is a diagram illustrating an example of a configuration of an organic light-emitting display device according to embodiments of the present disclosure.

Referring to FIG. 1, an organic light-emitting display device 100 includes a display panel 110, a gate driver 120, a data driver 130, and a timing controller 140.

The display panel 110 includes a plurality of gate lines GL1, . . . , GLn and a plurality of data lines DL1, . . . , DLm which overlap each other. The display panel 110 includes a plurality of subpixels 101 that are formed to correspond to areas in which the plurality of gate lines GL1, . . . , GLn and the plurality of data lines DL1, . . . , DLm overlap each other. Each of the plurality of subpixels 101 includes an organic light emitting diode (not illustrated) and a pixel circuit (not illustrated) that supplies a drive current to the organic light emitting diode. The pixel circuit is connected to one of the gate lines GL1, . . . , GLn and one of the data lines DL1, . . . , DLm and can supply a drive current to the organic light emitting diode. Lines that are disposed in the display panel 110 are not limited to the plurality of gate lines GL1, . . . , GLn and the plurality of data lines DL1, . . . , DLm.

The data driver 120 can supply a data signal to the plurality of data lines DL1, . . . , DLm. The data signal corresponds to grayscale and a voltage level of the data signal is determined depending on the corresponding grayscale. The voltage of the data signal is referred to as a data voltage. The data driver 120 can supply a sensing signal to the plurality of data lines DL1, . . . , DLm. The voltage of the sensing signal is referred to as a sensing voltage. When the voltage supplied to the organic light emitting diode is lower than a threshold voltage of the organic light emitting diode, a current does not flow in the organic light emitting diode and the organic light emitting diode does not emit light. In order to prevent a current from flowing in the organic light emitting diode using the sensing voltage, the sensing voltage can be set to a voltage lower than the threshold voltage of the organic light emitting diode. The data driver 120 can sense a voltage which is supplied to the organic light emitting diode.

The data driver 120 can supply a compensation voltage to the plurality of data lines DL1, . . . , DLm. A voltage level of the compensation voltage corresponds to the data voltage. The data driver 120 can sequentially output the sensing voltage, the compensation voltage, and the data voltage in one section.

Here, the number of data drivers 120 is illustrated to be one, but the disclosure is not limited thereto. The number of data drivers 120 may be two or more depending on the size and the resolution of the display panel 110. The data driver 120 can be embodied as an integrated circuit.

The gate driver 130 can supply a gate signal to the plurality of gate lines GL1, . . . , GLn. The subpixels 101 corresponding to the gate lines GL1, . . . , GLn to which the gate signal has been supplied can receive a data signal. The gate driver 130 can supply a sensing control signal to the subpixels 101. The subpixels 101 to which the sensing control signal output from the gate driver 130 is supplied can be supplied with the sensing voltage output from the data driver 120. Here, the number of gate drivers 130 is illustrated to be one, but the disclosure is not limited thereto. The number of gate drivers 130 may be two or more. The gate drivers 130 may be disposed on both lateral sides of the display panel 110, one gate driver 130 may be connected to odd-numbered gate lines out of the plurality of gate lines GL1, . . . , GLn, and the other gate driver 130 may be connected to even-numbered gate lines out of the plurality of gate lines GL1, . . . , GLn. However, the disclosure is not limited thereto. The gate driver 130 can be embodied as an integrated circuit.

The timing controller 140 can control the data driver 120 and the gate driver 130. The timing controller 140 can supply sensing data corresponding to the sensing signal and image data corresponding to the data signal to the data driver 120. The timing controller 140 can sequentially output the sensing data and the image data in one frame section. The sensing data and the image data can be digital signals.

The timing controller 140 can correct a data signal and supply the corrected data signal to the data driver 120. The operation of the timing controller 140 is not limited thereto.

The timing controller 140 can be embodied as an integrated circuit. The timing controller 140 can correct a data signal on the basis of the sensing signal and supply the corrected data signal to the data driver 120.

The organic light-emitting display device 100 according to the disclosure may further include an image analyzing circuit 150 (which may be referred to herein as an image analyzing unit 150). The image analyzing unit 150 analyzes image data, determines a voltage level of a compensation voltage, and supply information on the determined voltage level of the compensation voltage to the timing controller 140. The image analyzing unit 150 is illustrated to be an element separate from the timing controller 140, but the disclosure is not limited thereto. The image analyzing unit 150 and the timing controller 140 can be included in one integrated circuit. The image analyzing circuit 150 may include any electrical circuitry, features, components or the like configured to perform the various operations of the image analyzing circuit 150 as described herein. In some embodiments, one or more of the image analyzing circuit 150 may be included in or otherwise implemented by processing circuitry such as a microprocessor, microcontroller, integrated circuit or the like.

Figure 2:
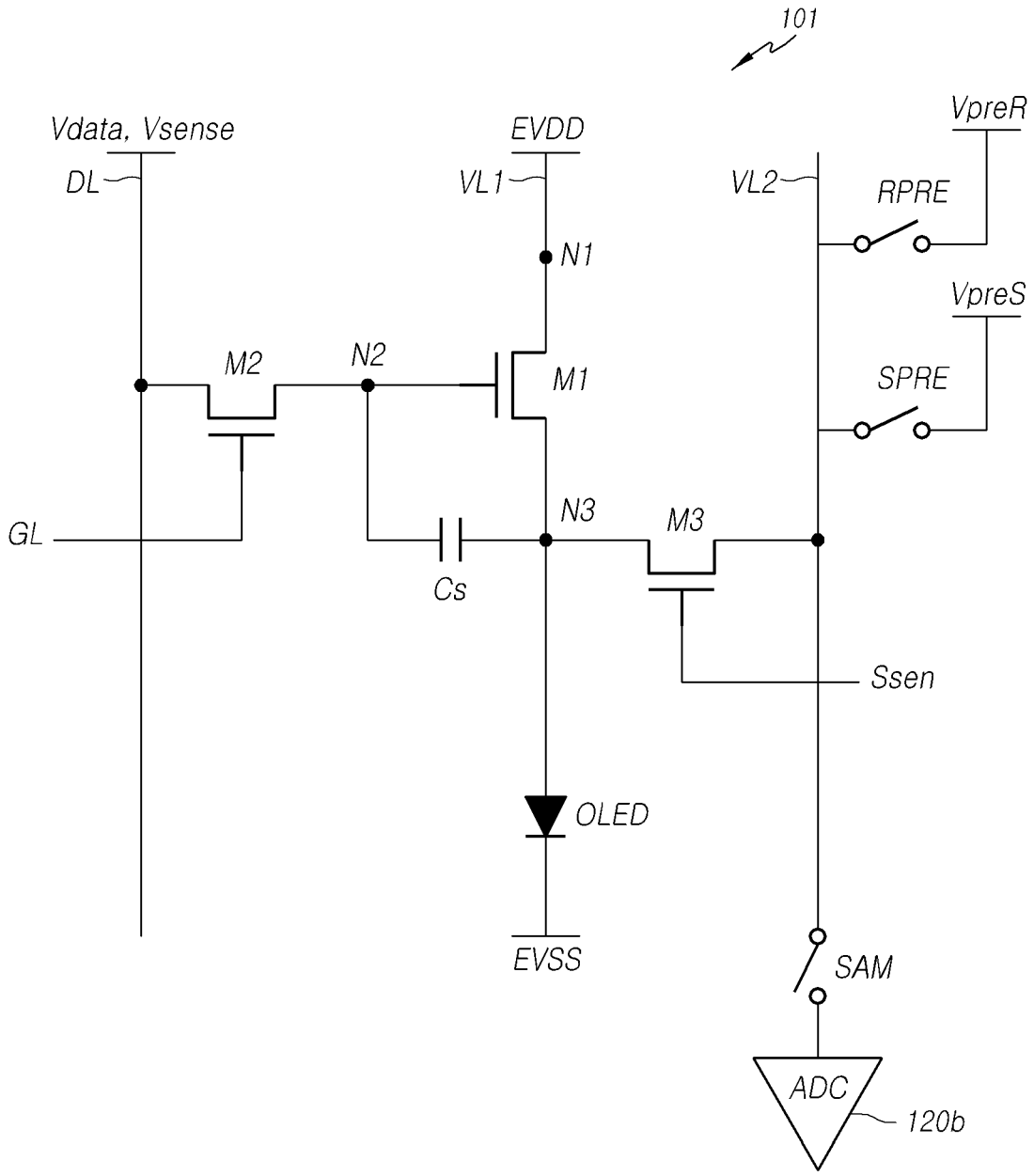
FIG. 2 is a circuit diagram illustrating an example of a subpixel illustrated in FIG. 1.
Figure 3A:
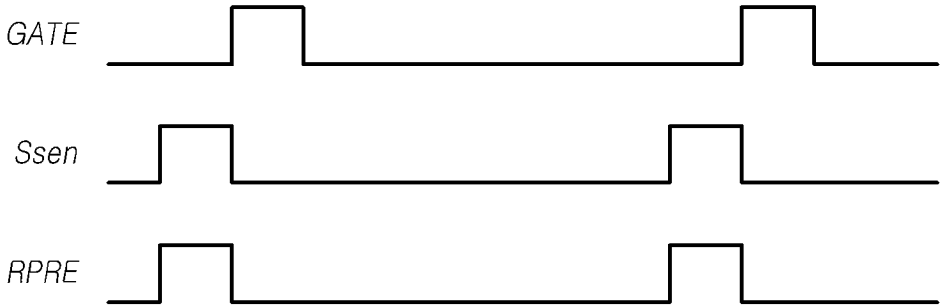
FIG. 3A is a timing diagram illustrating a process of generating a drive current in a subpixel.
Figure 3B:
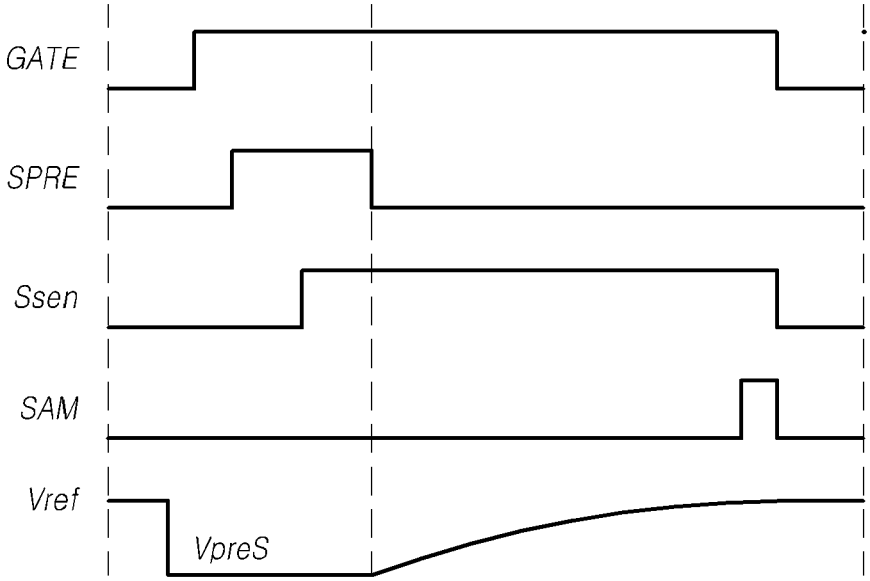
FIG. 3B is a timing diagram illustrating a process of sensing a threshold voltage in a subpixel.
Figure 3C:
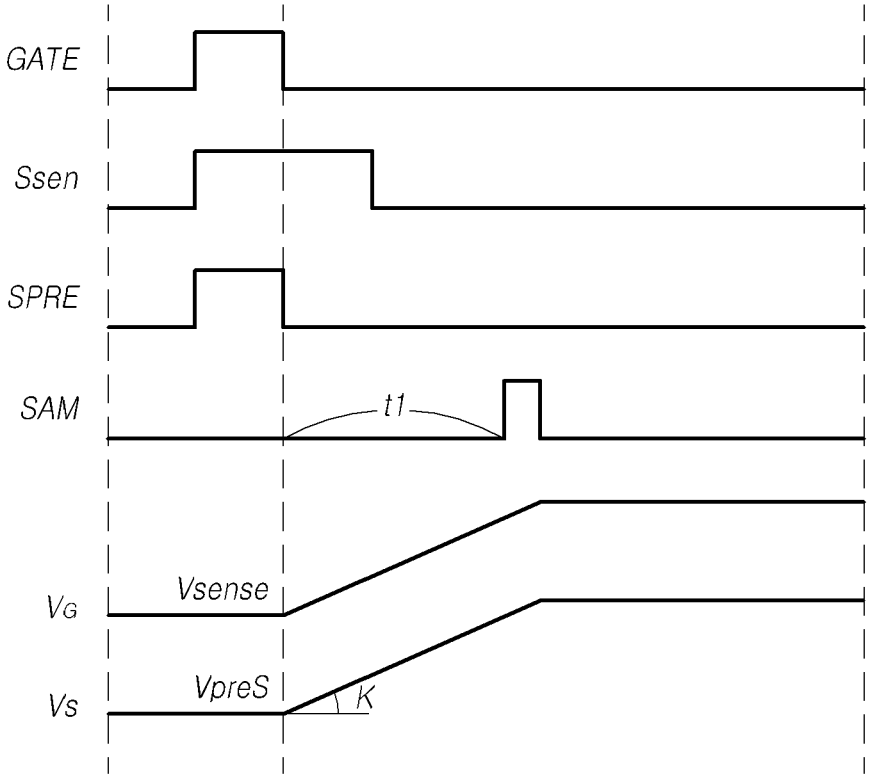
FIG. 3C is a timing diagram illustrating a process of sensing electron mobility in a subpixel.

FIG. 2 is a circuit diagram illustrating an example of a subpixel illustrated in FIG. 1. FIG. 3A is a timing diagram illustrating a process of generating a drive current in a subpixel, FIG. 3B is a timing diagram illustrating a process of sensing a threshold voltage in a subpixel, and FIG. 3C is a timing diagram illustrating a process of sensing electron mobility in a subpixel.

Referring to FIG. 2, a subpixel 101 includes an organic light emitting diode OLED and a pixel circuit that drives the organic light emitting diode OLED. The pixel circuit includes a first transistor M1, a second transistor M2, a third transistor M3, and a capacitor Cs.

In the first transistor M1, a first electrode is connected to a first node N1 connected to a first power supply line VL1 to which a pixel high-potential voltage EVDD is supplied, a gate electrode is connected to a second node N2, and a second electrode is connected to a third node N3. The first transistor M1 can allow a current to flow from the first node N1 to the third node N3 depending on a voltage which is supplied to the second node N2. The first electrode of the first transistor M1 may be a drain electrode and the second electrode may be a source electrode. However, the disclosure is not limited thereto.

The current flowing from the first node N1 to the third node N3 corresponds to Equation 1.

$$Id=k(V_{GS}-Vth)^2 \quad \text{Equation 1}$$

Here, Id represents a quantity of current flowing from the first node N1 to the third node N3, k represents electron mobility of a transistor, $V_{GS}$ represents a voltage difference between the gate electrode and the source electrode of the first transistor M1, and Vth represents a threshold voltage of the first transistor M1.

Accordingly, since the quantity of current varies depending on the electron mobility and the deviation in threshold voltage, it is possible to prevent degradation in image quality by correcting the data signal on the basis of the electron mobility and the deviation in threshold voltage.

In the second transistor M2, a first electrode is connected to the corresponding data line DL, a gate electrode is connected to the corresponding gate line GL, and a second electrode is connected to the second node N2. The second transistor M2 allows a data voltage Vdata corresponding to the data signal to be supplied to the second node N2 depending on the gate signal supplied via the gate line GL. The first electrode of the second transistor M2 may be a drain electrode and the second electrode may be a source electrode. However, the disclosure is not limited thereto.

In the third transistor M3, a first electrode is connected to the third node N3, a gate electrode is connected to a corresponding sensing control signal line Sense, and a second electrode is connected to a second power supply line VL2 for supplying a first initialization voltage VpreR or a second initialization voltage VpreS. The first initialization voltage VpreR or the second initialization voltage VpreS can initialize the voltage of the third node N3. The first initialization voltage VpreR can initialize the third node N3 when the data voltage Vdata is supplied to the data line DL, and the second initialization voltage VpreS can initialize the third node N3 when the sensing voltage Vsense is supplied to the data line DL. However, the disclosure is not limited thereto.

The voltage supplied to the third node N3 includes information corresponding to a characteristic value of the subpixel 101. Accordingly, it is possible to ascertain the characteristic value of the subpixel 101 using the voltage of the third node N3 and to compensate for the data signal. The characteristic value of the subpixel 101 may be the threshold value of the first transistor M1, the electron mobility, and deterioration information of the organic light emitting diode OLED. However, the disclosure is not limited thereto. The first electrode of the third transistor M3 may be a drain electrode and the second electrode may be a source electrode. However, the disclosure is not limited thereto.

The capacitor Cs is disposed between the second node N2 and the third node N3. The capacitor Cs can keep the voltage of the gate electrode and the voltage of the source electrode of the first transistor M1 constant.

In the organic light emitting diode OLED, an anode electrode is connected to the third node N3 and a cathode electrode is connected to a pixel low-potential voltage EVSS. Here, the pixel low-potential voltage EVSS may be a ground voltage. However, the disclosure is not limited thereto. The organic light emitting diode OLED can emit light depending on the quantity of current when a current flows from the anode electrode to the cathode electrode. The organic light emitting diode OLED can emit light of one color of red, green, blue, and white. However, the disclosure is not limited thereto.

A first switch RPRE and a second switch SPRE may be connected to the second power supply line VL2. The first switch RPRE selectively supplies the first initialization voltage VpreR to the second power supply line VL2, and the second switch SPRE selectively supplies the second initialization voltage VpreS to the second power supply line VL2.

An analog-digital converter **120*b* may be connected to the pixel circuit. The analog-digital converter 120*b* may be connected to the second power supply line VL2. The analog-digital converter 120*b* is supplied with the voltage of the third node N3 via the second power supply line VL2 and converts the supplied voltage into a digital signal. The analog-digital converter 120*b* may be connected to the second power supply line VL2 via a third switch SAM. When the third switch SAM is turned on, the analog-digital converter 120*b* can be supplied with the voltage of the third node N3. The digital signal which is converted by the analog-digital converter 120*b* is supplied to the timing controller 140**. However, the disclosure is not limited thereto.

The circuit of a subpixel employed by the organic light-emitting display device 100 is not limited thereto.

A process of supplying a drive current to an organic light emitting diode OLED in a pixel circuit will be described below with reference to FIG. 3A.

By turning on the first switch RPRE and turning on the third transistor M3 using the sensing control signal Ssen which is supplied via the sensing control signal line Sense, the third node N3 can be initialized using the first initialization voltage VpreR. Then, the first switch RPRE and the third transistor M3 are turned off. When the second transistor M2 is turned on by the gate signal GATE, the second node N2 is supplied with the data voltage Vdata. The first transistor M1 can allow a drive current to flow from the first node N1 to the third node N3 depending on the voltage between the second node N2 and the third node N3. Accordingly, the drive current can flow in the organic light emitting diode OLED depending on the data voltage Vdata.

A process of sensing a threshold voltage in a pixel circuit will be described below with reference to FIG. 3B.

First, the gate signal GATE is supplied to turn on the second transistor M2 in a state in which a preset voltage is applied to the data line DL. The preset voltage may be a sensing voltage Vsense. When the second transistor M2 is turned on, a voltage applied to the data line DL is supplied to the second node N2. The first transistor M1 allows a current to flow from the first node N1 to the third node N3 depending on the voltage supplied to the second node N2 and the voltage level of the third node N3 increases.

Then, the second switch SPRE is turned on. When the second switch SPRE is turned on, the second initialization voltage VpreS is supplied to the second power supply line VL2. When the sensing control signal Ssen is supplied via the sensing control signal line Sense after the second switch SPRE has been turned on, the third transistor M3 is turned on. After the third transistor M3 is turned on, the second switch SPRE is turned off. When the third transistor M3 is turned on in a state in which the second switch SPRE is turned off, the voltage of the third node N3 increases and the third switch SAM can be turned on when a selected time elapses after the increase of the voltage of the third node N3 has been started. When the third switch SAM is turned on, the voltage of the third node N3 is supplied to the analog-digital converter 120*b*. The third switch SAM can be turned on at a time point at which the voltage of the third node N3 does not increase any mode. At this time, the voltage sensed by the analog-digital converter 120*b* is compared with a preset voltage to sense the threshold voltage of the first transistor M1.

A process of sensing electron mobility in a pixel circuit will be described below with reference to FIG. 3C.

First, the gate signal GATE is supplied to turn on the second transistor M2 in a state in which a preset voltage is supplied to the data line DL. The preset voltage may be a sensing voltage Vsense. When the second transistor M2 is turned on, the sensing voltage Vsense supplied to the data line DL is supplied to the second node N2. The third transistor M3 is turned on by the sensing control signal Ssen. At this time, the second switch SPRE is turned on. When the third transistor M3 and the second switch SPRE are turned on, the second initialization voltage VpreS is supplied to the third node N3.

The second transistor M2 is turned off by the gate signal and the second switch SPRE are turned off. When the second transistor M2 and the second switch SPRE are turned off, the second node N2 and the third node N3 are in a floating state. At this time, the first transistor M1 allows a sensing current to flow to the second power supply line VL2 via the third transistor M3 depending on the voltage of the second node N2. The voltage of the second power supply line VL2 increases due to the sensing current and the voltage level of the third node N3 increases. At this time, the second node N2 is connected to the third node N3 via the capacitor Cs and thus the voltage level of the second node N2 also increases. The voltage of the third node N3 increases with a certain slope and this slope is indicative of the electron mobility. After a selected time t1 has elapsed, the third switch SAM is turned on and information on the electron mobility is supplied to the analog-digital converter 120*b*.

Figure 4:
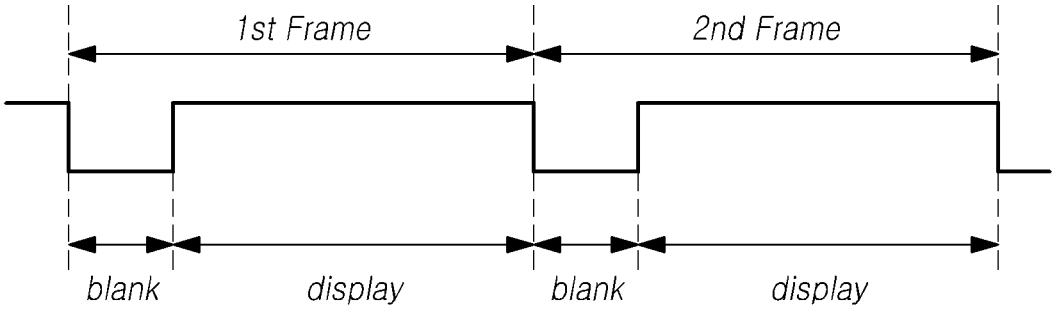
FIG. 4 is a waveform diagram illustrating operations of the organic light-emitting display device illustrated in FIG. 1.

FIG. 4 is a waveform diagram illustrating operations of the organic light-emitting display device illustrated in FIG. 1.

Referring to FIG. 4, the organic light-emitting display device can display an image including a plurality of frames. At this time, an image corresponding to one frame can be displayed in each frame section. The plurality of frames include a first frame section 1st frame and a second frame section 2nd frame. Each of the first frame section 1 st frame and the second frame section 2nd frame includes a blank section and a display section. In the display section, a gate signal is output and a data signal is supplied to display an image.

The organic light-emitting display device 100 which is driven as described above is supplied with black data not to display an image in the blank section and is supplied with a data signal to display an image in the display section. However, as illustrated in FIG. 2, the pixel circuit includes the corresponding data line DL and the second power supply line VL2, and the voltage supplied to the second power supply line VL2 can be changed by the voltage supplied to the data line DL. Accordingly, when the data line DL is supplied with black data and then supplied with a data signal, the voltage of the data line DL increases. Particularly, when a first data signal is supplied to the data line DL, the voltage of the data line DL increases. At this time, there may be a problem in that the voltage of the second power supply line VL2 increases with the increase of the voltage of the data line DL, the voltage level of the first initialization voltage VpreR increases accordingly, and the current flowing in the organic light emitting diode OLED is affected to degrade the image quality.

Figure 5:
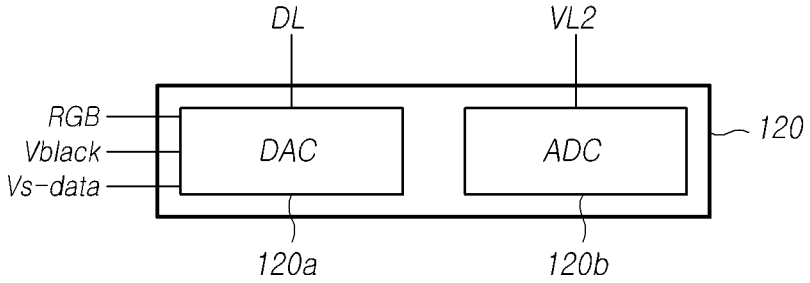
FIG. 5 is a diagram illustrating a configuration of a data driver illustrated in FIG. 1.

FIG. 5 is a diagram illustrating a configuration of the data driver illustrated in FIG. 1.

Referring to FIG. 5, the data driver 120 includes a digital-analog converter 120*a* and an analog-digital converter 120*b*. The digital-analog converter 120*a* is connected to the data lines DL and the analog-digital converter 120*b* is connected to the second power supply lines VL2. The digital-analog converter 120*a* and the analog-digital converter 120*b* are illustrated to be connected to one data line DL and one second power supply line VL2, respectively, but the disclosure is not limited thereto.

The digital-analog converter 120*a* is supplied with image data RGB from the timing controller 140. The digital-analog converter 120*a* is supplied with black data Vblack and compensation voltage information Vs_data corresponding to the compensation voltage VS. The digital-analog converter 120*a* can generate and supply a data signal, a black data signal, and a compensation voltage to the data lines DL.

The analog-digital converter 120*b* can convert a voltage supplied from the second power supply line VL2 into a digital signal.

Figure 6A:
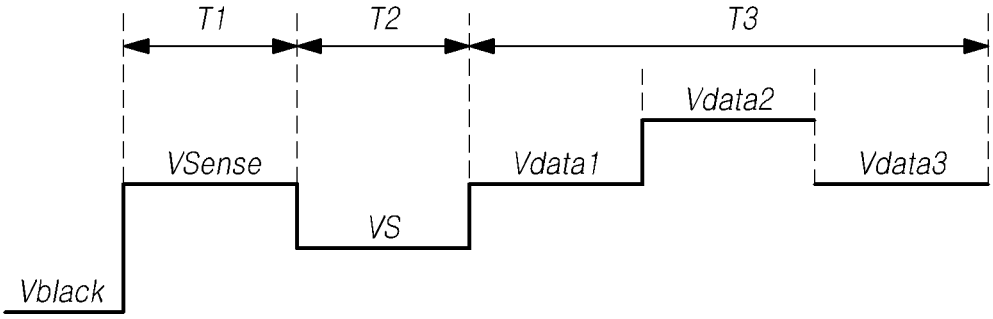
FIG. 6A is a waveform diagram illustrating an first example of a signal which is output from the data driver illustrated in FIG. 5 to data lines.
Figure 6B:
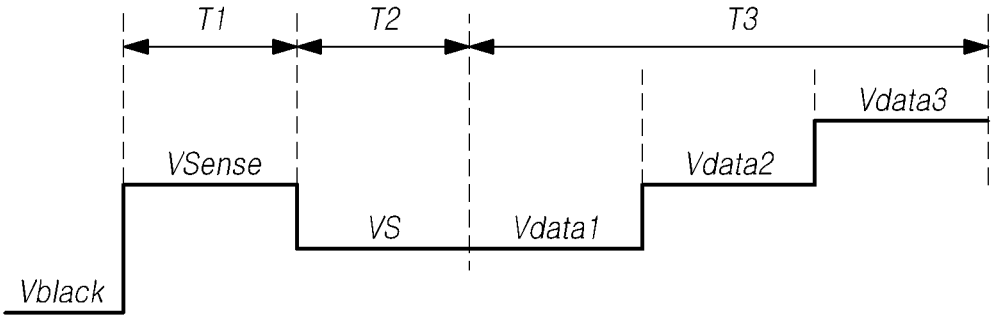
FIG. 6B is a waveform diagram illustrating a second example of a signal which is output from the data driver illustrated in FIG. 5 to data lines.
Figure 6C:
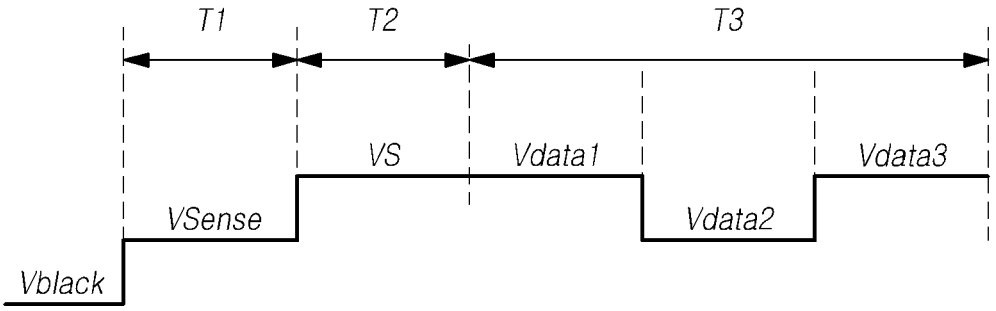
FIG. 6C is a waveform diagram illustrating a third example of a signal which is output from the data driver illustrated in FIG. 5 to data lines.

FIG. 6A is a waveform diagram illustrating a first example of a signal which is output from the data driver illustrated in FIG. 5 to the data lines, FIG. 6B is a waveform diagram illustrating a second example of a signal which is output from the data driver illustrated in FIG. 5 to the data lines, and FIG. 6C is a waveform diagram illustrating a third example of a signal which is output from the data driver illustrated in FIG. 5 to the data lines.

Referring to FIGS. 6A, 6B, and 6C, regarding the voltage output to the data lines DL, the sensing voltage Vsense can be output in a first section T1 after the black data voltage Vblack which is supplied in the blank section has been output. Then, the compensation voltage VS is output in a second section T2, and a first data voltage Vdata1, a second data voltage Vdata2, and a third data voltage Vdata3 are sequentially output in a third section T3. The number of data voltages which are supplied in the third section T3 is illustrated to be three (Vdata1, Vdata2, and Vdata3), but this is for convenience of explanation and the disclosure is not limited thereto. The number of data voltages which are output in one frame section may correspond to the number of gate lines of the display panel 110. The first section T1 and the second section T2 can be included in the blank section in FIG. 4 and the third section T3 can be included in the display section. The first to third sections T1 to T3 can be repeated.

Subpixels to which the sensing voltage Vsense is supplied in the first section T1 may be all the subpixels of the display panel 110. However, the disclosure is not limited thereto and the sensing voltage may be supplied to subpixels which are selected using a preset method in the first section. In the first section T1, the electron mobility k of the first transistor M1 can be sensed using the sensing voltage Vsense. However, the disclosure is not limited thereto. The compensation voltage VS can be supplied in the second section T2. Referring to FIG. 6A, the compensation voltage VS has a preset voltage level. When the voltage level of the first data voltage Vdata1 which is supplied in the third section T3 is lower than the voltage level of the compensation voltage VS in a state in which the voltage level of the compensation voltage VS is preset, the voltage level of the data lines DL increases. When the voltage level of the data lines DL increases, a problem may occurring that the voltage level of the second power supply line VL2 to which the first initialization voltage VpreS has been supplied also increases due to a coupling phenomenon and the first initialization voltage VpreS increases. Accordingly, a problem with a degradation in image quality of the display panel 110 may occur. In addition, a problem that the first initialization voltage VpreS decreases even when the voltage level of the first data voltage Vdata1 is lower than the voltage level of the compensation voltage VS.

However, as illustrated in FIG. 6B or 6C, the voltage level of the compensation voltage VS corresponds to the first data voltage Vdata1 which is supplied in the third section T3. That is, when the voltage level of the first data voltage Vdata1 which is supplied in the third section T3 is lower than the voltage level of the sensing voltage Vsense as illustrated in FIG. 6B or higher than the voltage level of the sensing voltage Vsense as illustrated in FIG. 6C, the voltage level of the data lines DL becomes equal to the voltage level of the first data voltage Vdata1 and is lower than or higher than the voltage level of the sensing voltage Vsense by the compensation voltage VS in the second section T2. Then, even when the first data voltage Vdata1 is supplied to the data lines DL, the voltage level of the data lines DL does not vary in the second section T2 and the third section T3, and the voltage level of the second power supply line VL2 does not vary.

Figure 7:
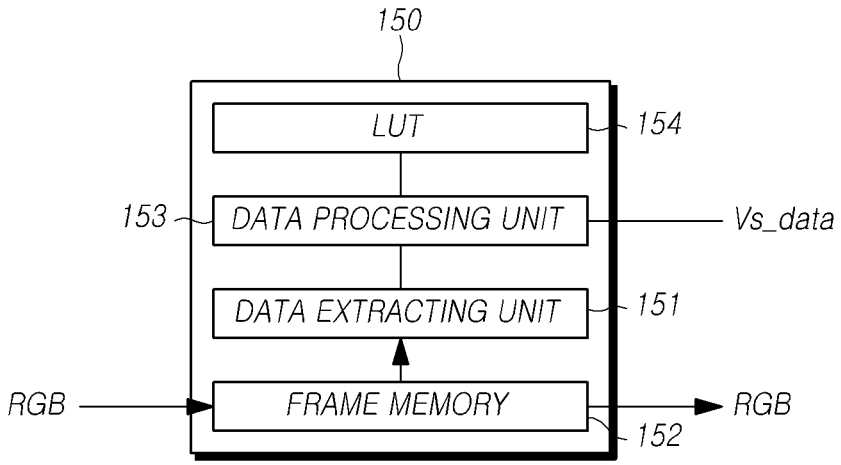
FIG. 7 is a diagram illustrating an example of a configuration of an image analyzing unit illustrated in FIG. 1.

FIG. 7 is a diagram illustrating an example of a configuration of the image analyzing unit illustrated in FIG. 1.

Referring to FIG. 7, the image analyzing unit 150 includes a data extracting circuit 151 (which may be referred to herein as a data extracting unit 151) that extracts image data stored in a frame memory 152, a lookup table 154 that stores compensation voltage information on the voltage level of the compensation voltage corresponding to the image data, and a data processing circuit 153 (which may be referred to herein as a data processing unit 153) that is supplied with the compensation voltage information Vs_data on the voltage level of the compensation voltage from the lookup table 154 depending on the image data extracted by the data extracting unit 151 and outputs the supplied compensation voltage information. The data extracting circuit 151, the data processing circuit 153, and the image analyzing circuit 150 may include any electrical circuitry, features, components or the like configured to perform the various operations of the data extracting circuit 151, the data processing circuit 153, and the image analyzing circuit 150 as described herein. In some embodiments, one or more of the data extracting circuit 151, the data processing circuit 153, and the image analyzing circuit 150 may be included in or otherwise implemented by processing circuitry such as a microprocessor, microcontroller, integrated circuit or the like.

The frame memory 152 is supplied with image data RGB from an external device (not illustrated), stores the supplied image data, and supplies the stored image data RGB to the timing controller 140. The frame memory 152 can store image data RGB corresponding to at least one frame. The data extracting unit 151 can extract first data from the image data RGB stored in the frame memory 152. The first data may be image data corresponding to the first data voltage Vdata1 illustrated in FIGS. 6A and 6B. That is, the first data corresponds to the data signal which is input to the subpixels connected to the first gate line of the display panel 110. The first data corresponds to a data signal which is input in a first horizontal period. The data processing unit 153 is supplied with the first data from the data extracting unit 151, is supplied with the compensation voltage information Vs_data corresponding to the compensation voltage VS corresponding to the first data stored in the lookup table 154, and outputs the compensation voltage information Vs_data. The compensation voltage information Vs_data is supplied to the timing controller 140.

Here, the frame memory 152 is illustrated to be an element of the image analyzing unit 150, but the disclosure is not limited thereto and the frame memory may be an element separate from the image analyzing unit 150.

Figure 8:
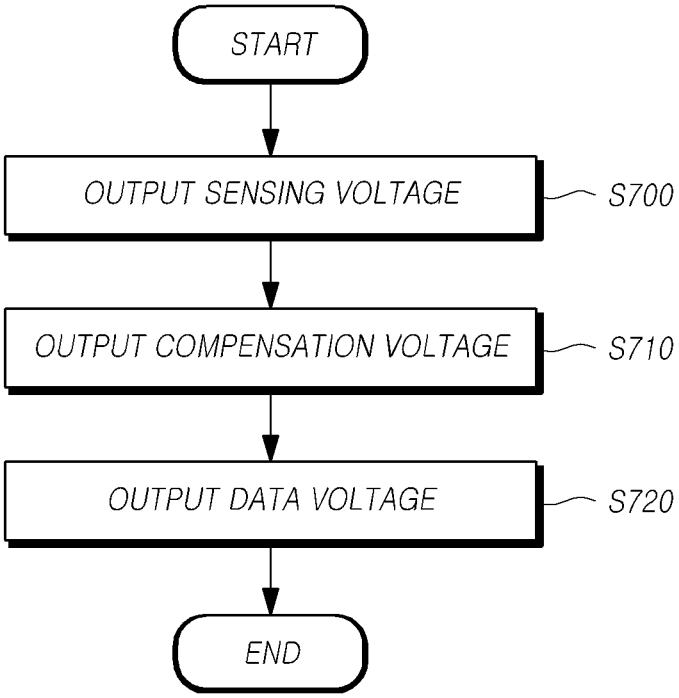
FIG. 8 is a flowchart illustrating a method of driving an organic light-emitting display device according to the disclosure.

FIG. 8 is a flowchart illustrating a method of driving an organic light-emitting display device according to the disclosure.

Referring to FIG. 8, the organic light-emitting display device 100 includes a plurality of data lines and a plurality of gate lines, and the organic light-emitting display device 100 drives an image including a plurality of frames. The method of driving the organic light-emitting display device 100 causes a sensing voltage to be output in one frame section at S700.

A compensation voltage is output in one frame section at S710. The voltage level of the compensation voltage corresponds to image data which is input in one frame section. Image data is stored for each frame in the frame memory, and the voltage level of the compensation voltage is determined using the image data stored in the frame memory. First data out of the image data stored in the frame memory is extracted and the voltage level of the compensation voltage corresponds to the first data. The first data may be image data corresponding to a data signal which is first output to the data lines in one frame section. The first data may be image data corresponding to the first data voltage Vdata1 in FIGS. 6B and 6C.

A data voltage is output in one frame section at S720. Accordingly, the sensing voltage, the compensation voltage, and the data voltage are output in the same frame section. Since the data voltage corresponds the voltage level of the compensation voltage which has been previously supplied, the voltage level of the data lines does not increase and the voltage level of the second power supply line VL2 does not increase nor decrease. Accordingly, since the voltage level of the first initialization voltage VpreR does not vary due to the data signal which is supplied to the data lines, it is possible to prevent a degradation in image quality from occurring in the display panel 110.

A frame section corresponding to one frame out of a plurality of frames includes a display section and a non-display section, a data signal is supplied to the data lines in the display section, and a sensing voltage and a compensation voltage are supplied in the non-display section.

The above description and the accompanied drawings merely exemplify the technical idea of the present disclosure, and various modifications and changes such as coupling, separation, substitution, and change of elements can be made by those skilled in the art without departing from the essential features of the disclosure. The embodiments disclosed in the disclosure are not for restricting the technical idea of the disclosure but for explaining the technical idea of the disclosure. Accordingly, the technical scope of the disclosure is not limited by the embodiments. The scope of the disclosure is defined by the appended claims, and all the technical ideas within a range equivalent thereto should be construed as belonging to the scope of the disclosure.

The various embodiments described above can be combined to provide further embodiments. Further changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light-emitting display device, comprising:

a display panel in which a plurality of data lines and a plurality of gate lines are arranged to overlap each other and includes a plurality of subpixels which are adjacently arranged in areas in which the plurality of data lines and the plurality of gate lines overlap each other;

a data driver that supplies a data signal to the plurality of data lines;

a gate driver that supplies a gate signal to the plurality of gate lines; and a timing controller that controls the data driver and the gate driver to cause the data driver to output black data during an initial section of a frame, output a sensing voltage through the plurality of data lines during a first section, output a compensation voltage during a second section, and output a data voltage during a third section, wherein the initial section, the first section, the second section, and the third section are contiguous within the frame, wherein a voltage level of the compensation voltage corresponds to a voltage level of the data signal, wherein each of the plurality of subpixels includes:

a first transistor in which a first electrode is electrically connected to a first node electrically connected to a first power supply line to which a high-potential voltage is supplied, a gate electrode is electrically connected to a second node, and a second electrode is electrically connected to a third node;

a second transistor in which a first electrode is electrically connected to the corresponding data line, a gate electrode is electrically connected to the corresponding gate line, and a second electrode is electrically connected to the second node;

a third transistor in which a first electrode is electrically connected to the third node, a gate electrode is electrically connected to a sensing signal line, and a second electrode is electrically connected to a second power supply line for supplying an initialization voltage;

a capacitor that is electrically connected between the second node and the third node; and an organic light emitting diode in which a first electrode is electrically connected to the third node and a second electrode is electrically connected to a low-potential voltage, the organic light emitting diode having a threshold voltage, wherein the data line supplies the sensing voltage and the second power supply line supplies the initialization voltage in the first section, the data line supplies the compensation voltage in the second section, the data line supplies the data voltage in the third section, wherein when the second transistor is turned on, the data line supplies the sensing voltage to charge the second node and when the third transistor is turned on, the second power supply line supplies the initialization voltage to charge the third node, wherein when the second transistor is turned off and the second power supply line is electrically disconnected, the second node and the third node are in a floating state, wherein the first transistor allows a sensing current to flow to the second power supply line via the third transistor, and a voltage level of the third node increases based on the sensing current at a certain slope indicative of an electron mobility of the first transistor, wherein the timing controller includes an image analyzing circuit that includes a frame memory configured to store image data for each frame and a data processing circuit configured to extract first data corresponding to a first line of the display panel from the image data and to determine the voltage level of the compensation voltage on the basis of the first data, and wherein the sensing voltage is maintained constant during the first section at a first voltage level that is lower than the threshold voltage of the organic light emitting diode.

2. The organic light-emitting display device according to claim 1, wherein the image analyzing circuit includes a lookup table in which the voltage level of the compensation voltage is set for a grayscale value corresponding to the voltage level of the data signal.

3. The organic light-emitting display device according to claim 1, wherein the timing controller is supplied with information on the voltage level of the compensation voltage from the image analyzing circuit.

4. The organic light-emitting display device according to claim 1, wherein the data driver further includes an analog-digital converter and the analog-digital converter, and is supplied with a voltage of the third node in the first section.

5. The organic light-emitting display device according to claim 4, wherein the timing controller supplies an image signal to the data driver such that the image signal is corrected on the basis of the voltage of the third node and is supplied to the data driver.

6. The organic light-emitting display device according to claim 1, wherein the initial section in time precedes the first section in time, the first section in time precedes the second section in time, and the second section in time precedes the third section in time.

7. The organic light-emitting display device according to claim 1, wherein a voltage level of the black data during the initial section is lower than a voltage level of the sensing voltage during the first section.

8. The organic light-emitting display device according to claim 7, wherein the voltage level of the sensing voltage during the first section is lower than a voltage level of the compensation voltage during the second section.

9. The organic light-emitting display device according to claim 7, wherein the voltage level of the sensing voltage during the first section is greater than a voltage level of the compensation voltage during the second section.

10. The organic light-emitting display device according to claim 9, wherein the voltage level of the compensation voltage during the second section is greater than the voltage level of the black data during the initial section.

11. The organic light-emitting display device according to claim 1, wherein, when the first voltage level of the sensing voltage that is lower than the threshold voltage of the organic light emitting diode is supplied to the organic light emitting diode, the organic light emitting diode does not emit light.

* * * * *